US010087117B2

(12) United States Patent
Arthur et al.

(10) Patent No.: US 10,087,117 B2
(45) Date of Patent: Oct. 2, 2018

(54) EXPLOSIVE COMPOSITIONS AND RELATED METHODS

(71) Applicant: DYNO NOBEL INC., Salt Lake City, UT (US)

(72) Inventors: Jordan Arthur, Eagle Mountain, UT (US); Scott Hunsaker, Orem, UT (US); Verlene Lovell, Saratoga Springs, UT (US); Lee F. McKenzie, Lehi, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 15/621,663

(22) Filed: Jun. 13, 2017

(65) Prior Publication Data

US 2017/0283341 A1 Oct. 5, 2017

Related U.S. Application Data

(63) Continuation of application No. PCT/US2015/065453, filed on Dec. 14, 2015.

(60) Provisional application No. 62/091,864, filed on Dec. 15, 2014.

(51) Int. Cl.

| | |
|---|---|
| ***C06B 31/28*** | (2006.01) |
| ***C06B 47/14*** | (2006.01) |
| ***C10L 1/32*** | (2006.01) |
| ***C06B 31/08*** | (2006.01) |
| ***C10L 1/04*** | (2006.01) |
| *C06B 31/00* | (2006.01) |
| *D03D 23/00* | (2006.01) |
| *D03D 43/00* | (2006.01) |

(52) U.S. Cl.
CPC ..... *C06B 31/28* (2013.01); *C06B 31/08* (2013.01); *C06B 47/145* (2013.01); *C10L 1/04* (2013.01); *C10L 1/328* (2013.01)

(58) Field of Classification Search
USPC ..... 149/2, 46
See application file for complete search history.

(56) References Cited

U.S. PATENT DOCUMENTS

| | | | |
|---|---|---|---|
| 3,164,503 | A | 1/1965 | Gehrig |
| 3,447,978 | A | 6/1969 | Bluhm |
| 3,470,041 | A | 9/1969 | Gehrig |
| 3,779,821 | A | 12/1973 | Fujiki et al. |

(Continued)

FOREIGN PATENT DOCUMENTS

| | | | | |
|---|---|---|---|---|
| CN | 102452866 A | * | 5/2012 | ..... C06B 43/00 |
| DE | 4444473 | | 6/1998 | |

(Continued)

OTHER PUBLICATIONS

PCT/US2015/065453, International Search Report and Written Opinion, dated Apr. 8, 2016.

(Continued)

*Primary Examiner* — James E McDonough
(74) *Attorney, Agent, or Firm* — Stoel Rives LLP

(57) ABSTRACT

Explosive compositions are disclosed herein. The compositions include a diesel fuel and a vacuum gas oil. Some compositions disclosed herein include an emulsion that includes an oxidizer in a discontinuous phase and a blend of diesel fuel and vacuum gas oil in a continuous phase. Methods of manufacturing explosive compositions are also disclosed herein.

28 Claims, 4 Drawing Sheets

(56) References Cited

U.S. PATENT DOCUMENTS

| | | | |
|---|---|---|---|
| 3,930,911 | A | 1/1976 | Clark |
| 4,111,727 | A | 9/1978 | Clay |
| 4,141,767 | A | 2/1979 | Sudweeks et al. |
| 4,149,917 | A | 4/1979 | Wade |
| 4,181,546 | A | 1/1980 | Clay |
| 4,315,787 | A | 2/1982 | Hattori et al. |
| 4,404,050 | A | 9/1983 | Yorke et al. |
| 4,470,855 | A | 9/1984 | Bampfield |
| 4,496,405 | A | 1/1985 | Cechanski |
| 4,543,137 | A | 9/1985 | Edamura et al. |
| 4,548,659 | A | 10/1985 | Jessop |
| 4,548,660 | A | 10/1985 | Ikeda et al. |
| 4,555,278 | A | 11/1985 | Cescon et al. |
| 4,584,090 | A | 4/1986 | Farnsworth |
| 4,594,118 | A | 6/1986 | Curtin et al. |
| 4,708,753 | A | 11/1987 | Forsberg |
| 4,701,248 | A | 12/1987 | Yates et al. |
| 4,710,248 | A | 12/1987 | Yates et al. |
| 4,736,683 | A | 4/1988 | Bachman et al. |
| 4,786,400 | A | 11/1988 | Farnsworth |
| 4,790,890 | A | 12/1988 | Miller |
| 4,808,298 | A | 2/1989 | Peck et al. |
| 4,828,633 | A | 5/1989 | Forsberg |
| 4,836,870 | A | 6/1989 | Cunningham et al. |
| 4,875,950 | A | 10/1989 | Waldock et al. |
| 4,933,028 | A | 6/1990 | Mullay et al. |
| 4,936,933 | A | 6/1990 | Yabsley et al. |
| 4,992,118 | A | 2/1991 | Peng et al. |
| 5,007,973 | A | 4/1991 | Trapp et al. |
| 5,041,177 | A | 8/1991 | Hajto et al. |
| 5,074,939 | A | 12/1991 | Sanders et al. |
| 5,226,986 | A | 7/1993 | Hansen et al. |
| 5,322,576 | A | 6/1994 | Aitken et al. |
| 5,401,341 | A | 3/1995 | Forsberg et al. |
| 5,490,887 | A | 2/1996 | Cranney et al. |
| 5,500,062 | A | 3/1996 | Chattopadhyay |
| 5,512,079 | A | 4/1996 | Jahnke et al. |
| 5,518,517 | A | 5/1996 | Jahnke et al. |
| 5,858,055 | A | 1/1999 | Jahnke et al. |
| 5,920,031 | A | 7/1999 | Jahnke |
| 5,936,194 | A | 8/1999 | Marlow et al. |
| 6,054,493 | A | 4/2000 | Bush |
| 6,176,893 | B1 | 1/2001 | Bush |
| 6,176,950 | B1 | 1/2001 | Wood et al. |
| 6,200,398 | B1 | 4/2001 | Bush |
| 6,800,154 | B1 | 10/2004 | Carey et al. |
| 6,929,707 | B2 | 8/2005 | Mullay et al. |
| 6,939,420 | B2 | 9/2005 | Pollack |
| 6,942,744 | B2 | 9/2005 | Palmer |
| 8,357,724 | B2 | 1/2013 | Deroo et al. |
| 2003/0019552 | A1 | 1/2003 | Pollack et al. |
| 2003/0024619 | A1 | 2/2003 | Coolbaugh et al. |
| 2003/0201041 | A1 | 10/2003 | Hales et al. |
| 2003/0209300 | A1 | 11/2003 | Meduselac et al. |
| 2004/0055677 | A1 | 3/2004 | Filippini et al. |
| 2005/0155682 | A1 | 7/2005 | Ogata et al. |
| 2008/0220504 | A1 | 9/2008 | Saul et al. |
| 2009/0129998 | A1 | 5/2009 | Haizmann et al. |
| 2010/0126719 | A1 | 5/2010 | Sanders et al. |
| 2011/0139676 | A1 | 6/2011 | McGhee et al. |
| 2012/0055685 | A1 | 3/2012 | Sanders et al. |
| 2012/0067058 | A1 | 3/2012 | Strack et al. |
| 2013/0139716 | A1 | 6/2013 | Wolak et al. |
| 2014/0311634 | A1 | 10/2014 | McPhail et al. |

FOREIGN PATENT DOCUMENTS

| | | |
|---|---|---|
| EP | 0028908 | 5/1981 |
| EP | 0044664 | 7/1981 |
| GB | 1061631 | 2/1964 |
| GB | 1306546 | 6/1970 |
| WO | 1995020637 | 1/1995 |
| WO | 1999061395 | 12/1999 |
| WO | 2001002318 | 1/2001 |
| WO | 2009106324 | 9/2009 |

OTHER PUBLICATIONS

Refinery Feedstocks & Products—Properties and Specifications, Colorado School of Mines ,Sep. 9, 2014.

Chen, et al.,Experimental Study on Co-Hydroprocessing Canola Oil and Heavy Vacuum Gas Oil Blends, American Chemical Society, 27 ,2013 ,3306-3315.

Oliphant, et al.,An Analysis of Blasting Fume Production and Re-Entry Time: The Use of Paraffin Oil in AN-Type Explosive Compounds, The University of Queensland, viewed Jun. 20, 2017 https://espace.library.uq.edu.au/view/UQ:301675 ,2001.

Seregin, et al.,Influence of Fuel Composition on Combustion in High-Speed Diesels, Chemistry and Technology of Fuels and Oils, vol. 14 No. 3-4 ,Mar.-Apr. 1978 ,259-262.

Zhou, et al.,Preparation of Freeze Resistant Expanded Ammonium Nitrate Explosive, School of Chemical Engineering, Nanjing University of Science & Technology, Energetic Materials, vol. 13 No. 1, China ,Feb. 2005.

Office Action dated Aug. 11, 2017 for U.S. Appl. No. 15/621,696.

Office Action dated Dec. 29, 2017 for U.S. Appl. No. 15/621,696.

* cited by examiner

EXPLOSIVE COMPOSITIONS AND RELATED METHODS

CROSS-REFERENCE TO RELATED APPLICATIONS

This application is a continuation of International Application No. PCT/US2015/065453, filed Dec. 14, 2015 which claims priority to U.S. Provisional Application No. 62/091,864, filed Dec. 15, 2014, both of which are hereby incorporated by reference in their entirety.

TECHNICAL FIELD

The present disclosure generally relates to the field of explosives. More particularly, the present disclosure relates to explosive compositions and related methods.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
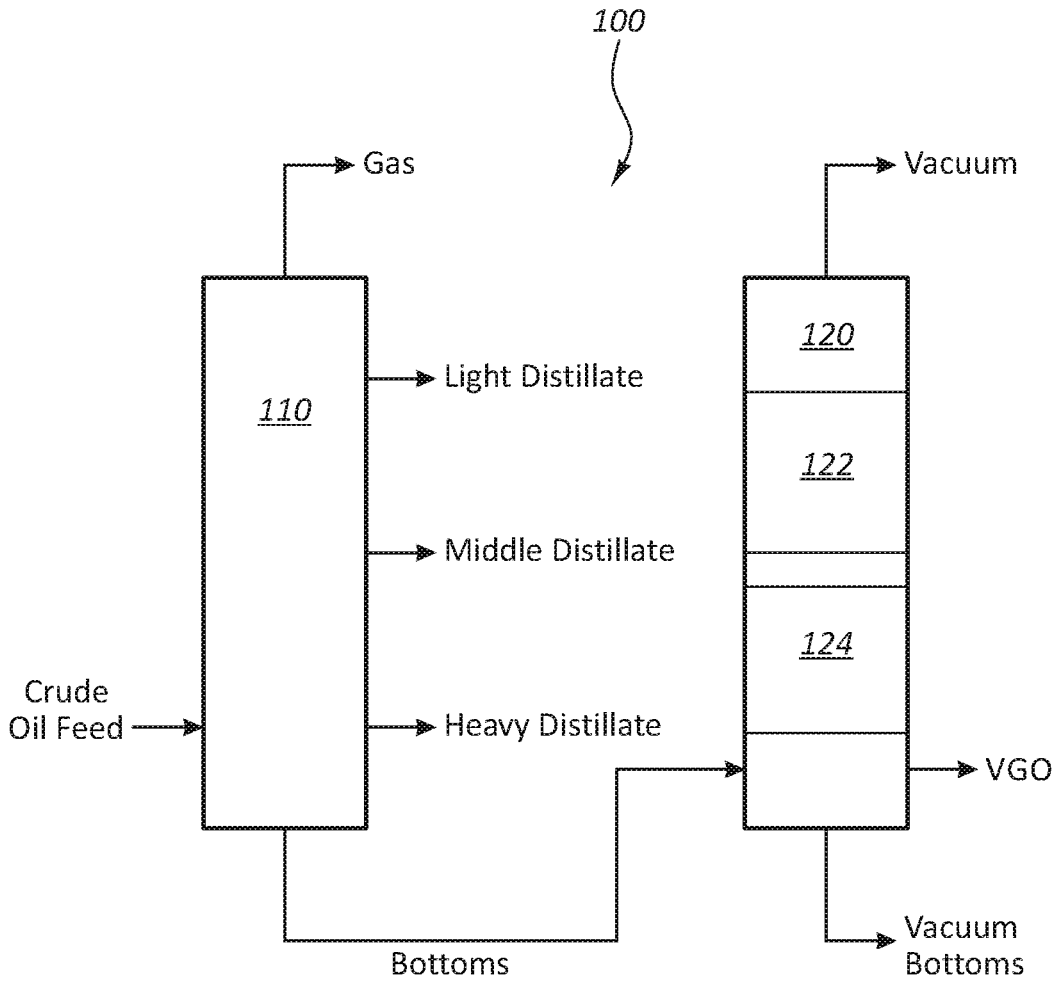
FIG. 1 is a schematic diagram of one embodiment of a distillation system for producing vacuum gas oil.

Explosive compositions are disclosed herein, along with related methods.

Explosives are commonly used in the mining, quarrying, and excavation industries for breaking rocks and ore. Generally, a hole, referred to as a "blasthole," is drilled in a surface, such as the ground. Cartridges filled with explosive materials may then be placed in the blastholes. Alternatively, the explosives may be manufactured onsite and may be pumped or augered into the blasthole. For the pumped or augered explosives, separate booster charges may be placed in the blastholes. Detonation of the booster charges are used to detonate the explosives. The cartridged explosives may include a built-in booster charge.

ANFO (ammonium nitrate fuel oil) is an example of an explosive mixture that may be manufactured onsite. For example, a truck with separate containers for ammonium nitrate prill and fuel oil and mixing equipment may be driven to a blast site near a blasthole. Augers may be used to mix the prill and fuel oil into an explosive mixture and to convey the resulting explosive mixture to a chute or discharge orifice that can be located over the blasthole. The explosive mixture may then be poured into the blasthole. Explosive mixtures delivered this way are referred to as "augered" explosives.

Emulsion explosives are another example of explosives that may be manufactured onsite. Emulsion explosives are generally transported to a blast site as an emulsion matrix that is too dense to completely detonate. The emulsion matrix may comprise fuel oil as the continuous phase and an aqueous oxidizer solution as the discontinuous phase (i.e., the droplets). In general, the emulsion matrix needs to be "sensitized" in order to become an "emulsion explosive" and detonate successfully. Sensitizing is often accomplished by introducing small voids into the emulsion. These voids act as hot spots for propagating detonation. These voids may be introduced by blowing a gas into the emulsion matrix, adding microspheres or other porous media, and/or injecting chemical gassing agents to react in the emulsion matrix and thereby form gas.

For example, for chemical gassing, a truck with all of the necessary chemicals and processing equipment drives to a blast site. The trucks may be referred to as a Mobile Manufacturing Unit ("MMU") or Mobile Processing Unit ("MPU"). The trucks have a compartment containing the emulsion matrix and one or more compartments for the chemical gassing agents. Pumps move the emulsion matrix to one or more mixers that introduce the chemical gassing agents to the emulsion matrix. The resulting sensitized emulsion explosive is generally pumped via a hose into the blasthole (complete gassing and sensitizing may occur in the blasthole as gas bubbles continue to form). Emulsion explosives delivered this way are referred to as "pumped" explosives.

Additionally, the two above examples may also be blended together. For example, a truck may have a fuel oil compartment, ammonium nitrate prill compartment, emulsion matrix compartment, chemical gassing agent compartment(s), and the necessary pumps and augers. Ammonium nitrate prill may be blended with the emulsion explosive (either before or after sensitizing) prior to being pumped into the blasthole. Likewise, ANFO may be blended with the emulsion explosive (either before or after sensitizing). The ratio of ANFO to emulsion explosive determines whether the resulting blend (often referred to as Heavy ANFO or HANFO) is augered or pumped to the blasthole.

In some embodiments of an emulsion matrix for use in explosives, the emulsion matrix comprises a continuous phase and a discontinuous phase. The discontinuous phase may comprise an oxidizer, and the continuous phase may comprise a diesel fuel and vacuum gas oil where the continuous phase is about 10% to about 35% vacuum gas oil by weight. The discontinuous phase may constitute more than 85% of the emulsion matrix by weight.

In some embodiments of an emulsion matrix for use in explosives, the continuous phase is about 15% to about 30% vacuum gas oil, about 16% to about 29% vacuum gas oil, about 17% to about 28% vacuum gas oil, about 18% to about 27% vacuum gas oil, about 19% to about 26% vacuum gas oil, or about 20% to about 25% vacuum gas oil by weight.

In some embodiments of an emulsion matrix for use in explosives, a blend of the diesel fuel and the vacuum gas oil in the continuous phase has a viscosity of about 100 cP to about 8000 cP, about 100 cP to about 400 cP, about 100 cP to about 2000 cP or about 100 cP to about 1000 cP at −20° C. and atmospheric pressure.

In some embodiments of an emulsion matrix for use in explosives, the emulsion matrix further comprises an emulsifier. For instance, in some embodiments, the emulsion matrix comprises about 0.5% to about 1.5% emulsifier by weight.

In some embodiments of an emulsion matrix for use in explosives, the discontinuous phase comprises an aqueous solution, such that the emulsion matrix comprises a water-in-oil emulsion. In other embodiments, the emulsion matrix comprises a melt-in-oil emulsion. The oxidizer may comprise a nitrate or perchlorate salt, such as ammonium nitrate.

In some embodiments of an emulsion explosive, the emulsion explosive comprises a VGO-containing emulsion matrix as disclosed above and a sensitizing agent. For example, the sensitizing agent may comprise microspheres, porous media, or gas bubbles, such as chemically generated or blown in gas bubbles. The emulsion explosive may be packaged in a cartridge. The emulsion explosive may be sensitized at a blastsite before or during pumping into a blasthole. For example, a truck for manufacturing conventional emulsion explosive may be used to manufacture VGO-containing emulsion explosive.

In some embodiments of a fuel for use in explosive mixtures, the fuel comprises a blend of a diesel fuel and a vacuum gas oil, wherein the fuel is about 20% to about 70%, about 25% to about 66%, about 33% to about 50%, or about 40% to about 66% vacuum gas oil by weight.

In some embodiments of a fuel for use in explosive mixtures, the blend of the diesel fuel and the vacuum gas oil has a viscosity of about 1000 cP to about 8000 cP, about 1500 cP to about 7000 cP, about 1500 cP to about 2500 cP, or about 4000 cP to about 7000 cP at −20° C. and atmospheric pressure. The blend of the diesel fuel and the vacuum gas oil may have a viscosity of about 50 cP to about 2000 cP, about 100 cP to about 1000 cP, about 200 cP to about 700 cP, or about 250 cP to about 500 cP at 0° C. and atmospheric pressure. The blend of the diesel fuel and the vacuum gas oil may have a viscosity of less than about 200 cP or less than about 50 cP at 20° C. and atmospheric pressure.

In some embodiments, an explosive mixture may comprise a VGO-containing fuel as disclosed above and an oxidizer. The oxidizer may be in the form of a prill. The oxidizer may comprise a nitrate or perchlorate salt, such as ammonium nitrate. The ratio of oxidizer to fuel may be greater than about 9:1 by weight (e.g., about 94% oxidizer and about 6% fuel). The fuel may be essentially devoid of water.

The explosive mixture may be packaged in a cartridge. The explosive mixture may be manufactured onsite and augered into a blasthole, such as with a truck with separate compartments for the oxidizer and VGO-containing fuel. For example, a truck for manufacturing conventional explosive mixtures, such as ANFO, may be used to manufacture VGO-containing explosive mixtures.

A method of making an emulsion explosive may comprise (1) providing an emulsion matrix (such as those described above) and (2) sensitizing the emulsion matrix to form an emulsion explosive. Some such methods may further comprise transporting the emulsion matrix to a blast site and sensitizing the emulsion matrix to form the emulsion explosive as the emulsion matrix is pumped into the blasthole. In some embodiments, the method of making an emulsion explosive comprises blowing gas into the emulsion matrix, chemically gassing the emulsion matrix, introducing microspheres into the emulsion matrix, or a combination of any of the foregoing.

A method of making an explosive mixture may comprise (1) providing a fuel (such as the fuels described above) and (2) mixing the fuel with an oxidizer. In some methods, the oxidizer comprises ammonium nitrate prill. In some embodiments, a method of making an explosive mixture comprises transporting the fuel and the oxidizer to a blast site on a truck and mixing the fuel and the oxidizer on the truck.

The following disclosure may pertain to any of the embodiments described above. For instance, in any of the embodiments described above, the vacuum gas oil may have a viscosity of about 30 cP to about 400 cP, 30 cP to about 100 cP, 100 cP to about 300 cP, or about 125 cP to about 250 cP at 40° C. and atmospheric pressure.

In the disclosed embodiments, the diesel fuel may be miscible with the vacuum gas oil at standard temperature and pressure.

The vacuum gas oil may comprise hydrocarbon molecules. In some embodiments, 85% or more of the hydrocarbon molecules have more than about 20 carbon atoms. For example, over 90% of the hydrocarbon molecules may have more than about 20 carbon atoms. Similarly, over about 95%, about 96%, about 97%, about 98%, or about 99% of the hydrocarbons may have about 17 or more carbon atoms. About 50% to about 75%, about 55% to about 70%, or about 60% to about 70% of the hydrocarbon molecules may have about 20 to about 40 carbon atoms. About 15% to about 40% or about 15% to about 25% of the hydrocarbon molecules may have about 40 to about 60 carbon atoms.

Figure 2:
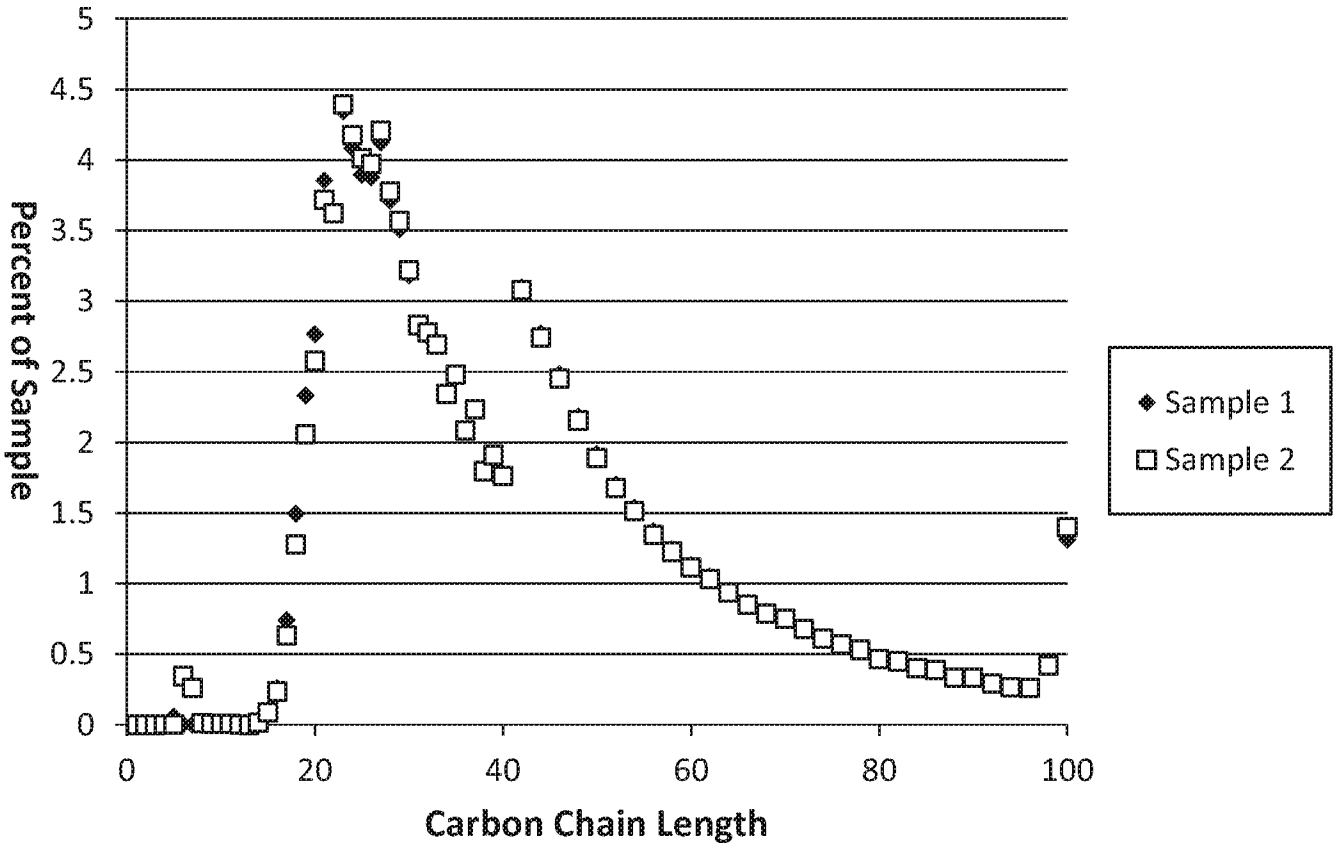
FIG. 2 is a graph depicting the carbon chain length distribution for two exemplary samples of vacuum gas oil.

In some embodiments, a distribution of carbon chain lengths for the hydrocarbon molecules comprises an absolute maximum peak at about 20 to about 30 carbon atoms, such as at or about 23 carbon atoms (see, e.g., FIG. 2). Additionally, the distribution of carbon chain lengths may further comprise a first local maximum peak at about 21 carbon atoms (see, e.g., FIG. 2) and a second local maximum peak at about 27 carbon atoms (see, e.g., FIG. 2).

Generally speaking, vacuum gas oil ("VGO") refers to a petroleum-based distillate that is obtained by distillation under reduced pressure or a blend of such petroleum-based distillates. Generally speaking, "diesel fuel" refers to middle distillates obtained from atmospheric distillation and similar fuels that are suitable for use in common high-speed diesel engines. Diesel fuel is a common refinery product. VGO, on the other hand, is generally considered an intermediate and not traditionally marketed by refineries.

Vacuum gas oil may be obtained by any suitable vacuum distillation process. An exemplary process for obtaining vacuum gas oil is described as follows with reference to FIG. 1. FIG. 1 depicts a simplified distillation system 100. The distillation system 100 comprises an atmospheric distillation column 110 and a vacuum distillation column 120, such as are common at crude oil refineries. To isolate vacuum gas oil from crude oil, crude oil may initially be fed into the atmospheric distillation column 110. Upon heating, crude oil components may separate from one another based on, for example, their boiling points. For instance, crude oil components with a relatively low boiling point may separate from components with a relatively high boiling point such that the components with the relatively low boiling point are disposed within the atmospheric distillation column 110 at a location that is above the components with a higher boiling point. For example, distillation carried out with the atmospheric distillation column 110 may produce a heavy distillate that comprises components that have a relatively high boiling point, a middle distillate that comprises components that have an intermediate boiling point, and a light distillate that comprises components that have a relatively low boiling point. Components with a lower boiling point than the light distillate may be removed as gas. In some circumstances, diesel fuel may be isolated from a middle distillate.

After fractional distillation has been carried out using the atmospheric distillation column 110 at atmospheric pressure, the "bottoms" of the atmospheric distillation column (i.e., the material that did not substantially volatilize during distillation of the crude oil in the atmospheric distillation column 110) may be transferred to the vacuum distillation column 120, configured to operate under reduced pressure. Due to the reduced pressure in the vacuum distillation column 120, components of the bottoms from the atmospheric distillation column 110 may be volatilized and separated by fractional distillation. In some embodiments, such as that depicted in FIG. 1, the vacuum distillation column 120 comprises two or more packed bed sections, such as a first packed bed section 122 and a second packed bed section 124. In some circumstances, vacuum gas oil may be removed from the vacuum distillation column 120. For example, in some circumstances, vacuum gas oil may be removed from the vacuum distillation column 120 at a location disposed below both the first packed bed section 122 and the second packed bed section 124.

It should be understood that FIG. 1 is not drawn to scale. Additionally, the location of the feeds (i.e., inputs) and draws (i.e., outputs) are for illustrative purposes and are not exact. There may also be additional feeds and/or draws beyond those illustrated. For example, some vacuum distillation columns have a light VGO draw and a heavy VGO draw that are blended together to form a VGO stream. For example, in a vacuum distillation column 120 with three packed bed sections, a light VGO stream may be drawn from below the first packed bed section, a heavy VGO stream may be drawn from below the second packed bed section, and the feed (atmospheric bottoms) may come in below the third packed bed section.

Accordingly, in some embodiments, the vacuum gas oil is obtained by vacuum distillation of material that did not substantially volatilize during distillation of crude oil at atmospheric pressure.

In some embodiments, the vacuum distillation column used for vacuum distillation comprises packed bed sections. For example, in some embodiments, the vacuum distillation column comprises two or more packed bed sections and the vacuum gas oil is drawn from below the two or more packed bed sections. In some embodiments, the vacuum gas oil is obtained by vacuum distillation of material that is fed into the vacuum distillation column below the two or more packed bed sections. In some embodiments, the vacuum distillation is performed at about 230° C. to about 600° C., about 230° C. to about 315° C., or about 450° C. to about 600° C.

In some embodiments, the vacuum gas oil is obtained by a process that comprises distillation at one or more pressures of about 1 mmHg to about 100 mmHg.

In some embodiments, the vacuum gas oil has an American Petroleum Institute ("API") gravity of about 10° API to about 30° API, about 20° API to about 30° API, about 21° API to about 29° API, about 22° API to about 28° API, about 23° API to about 27° API, or about 24° API to about 26° API.

In some embodiments, the vacuum gas oil has a pour point of about 20° C. to about 50° C., about 35° C. to about 60° C., or about 40° C. to about 50° C.

In some embodiments, the vacuum gas oil has a flash point of about >110° C. to about >150° C., about >115° C. to about >145° C., about >120° C. to about >140° C., or about >125° C. to about >135° C.

In some embodiments, the vacuum gas oil has an aniline point of about 80° C. to about 120° C., about 80° C. to about 110° C., about 85° C. to about 110° C., about 90° C. to about 105° C., or about 95° C. to about 105° C.

In some embodiments, vacuum gas oil has an initial boiling point of about 200° C. to about 400° C., about 225° C. to about 375° C., about 250° C. to about 375° C., about 250° C. to about 350° C., about 250° C. to about 325° C., or about 250° C. to about 300° C.

In some embodiments, the vacuum gas oil volatilizes at about 230° C. to about 600° C., about 230° C. to about 315° C., or about 315° C. to about 600° C.

In some embodiments, the diesel fuel is number 2 fuel oil.

In some embodiments, the diesel fuel has a viscosity of less than about 100 cP at −20° C. and atmospheric pressure. In some embodiments, the diesel fuel has a viscosity of less than about 50 cP at 20° C. and atmospheric pressure.

In some embodiments, the diesel fuel comprises hydrocarbon molecules and more than about 90% of the hydrocarbon molecules have about eight to about 21 carbon atoms.

Example1—Vacuum Gas Oil Characterization

Vacuum gas oil was obtained from a refinery. The vacuum gas oil obtained was produced by fractional distillation of crude oil. More particularly, crude oil was first distilled under atmospheric pressure. Material that did not substantially volatilize during distillation of crude oil at atmospheric pressure ("the bottoms") was then subjected to vacuum distillation under reduced pressure at approximately 275° C. The distillation column used for vacuum distillation included two packed beds. A vacuum gas oil distillate fraction below the two backed beds was removed from the vacuum distillation column. This vacuum gas oil was tested and characterized as specified in Table 1.

TABLE 1

| Method | Test | Result |
|---|---|---|
| ASTM D5002 | API Gravity at 60° F. | 25.5° API |
| ASTM D4294 | Sulfur Content, mass % | 0.205 |
| ASTM D97 | Pour Point | 39° C./102° F. |
| ASTM D4530 | Carbon Residue, % (m/m) | 1.55 |
| | Micro Carbon Residue, % (m/m) | 1.55 |
| ASTM D93 Proc. B | Manual/Automated | Automatic |
| | Flash Point | >130.0° C./>266° F. |
| ASTM D11 Proc. E | Aniline Point | 101.1° C./214.0° F. |
| IP PM-CW (ICP) | Copper, ppm (mg/kg) | 0.1 |
| | Iron, ppm (mg/kg) | 14 |
| | Nickel, ppm (mg/kg) | 0.5 |
| | Sodium, ppm (mg/kg) | 27.4 |
| | Vanadium, ppm (mg/kg) | 0.3 |
| ASTM D1160 | AET at IBP | 275° C. |
| | AET at 5% Recovered | 348° C. |
| | AET at 10% Recovered | 363° C. |
| | AET at 20% Recovered | 387° C. |
| | AET at 30% Recovered | 414° C. |
| | AET at 40% Recovered | 443° C. |
| | AET at 50% Recovered | 455° C. |
| | AET at 60% Recovered | 491° C. |
| | AET at 70% Recovered | 541° C. |
| | AET at 80% Recovered | 557° C. |
| | Recovery, vol % | 80.0 |
| | Residue, vol % | 20.0 |
| | Cold Trap Recovery, vol % | 0.0 |
| | Loss, vol % | 0.0 |

Example2—Determination of Boiling Point and Carbon Chain Length Distribution

The sample of vacuum gas oil from Example 1 ("Sample 1") and another vacuum gas oil sample from the same refinery ("Sample 2") were then analyzed by simulated distillation as specified in ASTM D7169. Sample 1 had been stored for about three or four years and sample 2 had been stored for a few months.

As set forth in ASTM D7169, each sample was subjected to increasing temperatures over time and the amount of sample that was pulled off was measured by gas chromatography as a function of temperature. Detected portions of the samples were grouped as indicated in Tables 2 and 3.

TABLE 2

| Sample 1 | | | |
|---|---|---|---|
| Carbon Chain Length | Temperature Range (° F.) | Time Range (s) | Mass % of Total Sample Detected for Each Group (w/w) |
| C1 | −400.00 to −258.70 | −0.354 to −0.210 | 0.0000 |
| C2 | −258.70 to −127.50 | −0.210 to −0.077 | 0.0000 |
| C3 | −127.50 to −44.00 | −0.077 to 0.008 | 0.0000 |
| C4 | −44.00 to 31.10 | 0.008 to 0.084 | 0.0004 |
| C5 | 31.10 to 97.00 | 0.184 to 0.151 | 0.0037 |
| C6 | 97.00 to 157.00 | 0.151 to 0.330 | 0.3446 |
| C7 | 157.00 to 209.00 | 0.330 to 0.590 | 0.2608 |
| C8 | 209.00 to 259.00 | 0.590 to 1.268 | 0.0116 |
| C9 | 259.00 to 303.00 | 1.268 to 2.385 | 0.0083 |
| C10 | 303.00 to 345.00 | 2.385 to 3.695 | 0.0067 |
| C11 | 345.00 to 385.00 | 3.695 to 4.999 | 0.0067 |
| C12 | 385.00 to 421.00 | 4.999 to 6.251 | 0.0015 |
| C13 | 421.00 to 455.00 | 6.251 to 7.440 | 0.0001 |
| C14 | 455.00 to 489.00 | 7.440 to 8.566 | 0.0166 |
| C15 | 489.00 to 520.00 | 8.566 to 9.633 | 0.0856 |
| C16 | 520.00 to 549.00 | 9.633 to 10.650 | 0.2363 |
| C17 | 549.00 to 576.00 | 10.650 to 11.617 | 0.6320 |
| C18 | 576.00 to 601.00 | 11.617 to 12.539 | 1.2759 |
| C19 | 601.00 to 626.20 | 12.539 to 13.410 | 2.0558 |
| C20 | 626.20 to 649.80 | 13.410 to 14.227 | 2.5768 |
| C21 | 649.80 to 673.70 | 14.227 to 15.066 | 3.7174 |
| C22 | 673.70 to 695.00 | 15.066 to 15.815 | 3.6232 |
| C23 | 695.00 to 716.20 | 15.815 to 16.592 | 4.3923 |
| C24 | 716.20 to 736.00 | 16.592 to 17.319 | 4.1746 |
| C25 | 73600 to 755.20 | 17.319 to 18.006 | 4.0092 |
| C26 | 755.20 to 773.60 | 18.006 to 18.664 | 3.9727 |
| C27 | 773.60 to 791.40 | 18.664 to 19.333 | 4.2040 |
| C28 | 791.40 to 808.00 | 19.333 to 19.958 | 3.7764 |
| C29 | 808.00 to 824.70 | 19.958 to 20.575 | 3.5637 |
| C30 | 824.70 to 840.60 | 20.575 to 21.162 | 3.2193 |
| C31 | 840.60 to 855.70 | 21.162 to 21.710 | 2.8300 |
| C32 | 855.70 to 871.00 | 21.710 to 22.265 | 2.7759 |
| C33 | 871.00 to 885.20 | 22.265 to 22.826 | 2.6901 |
| C34 | 885.20 to 897.80 | 22.826 to 23.324 | 2.3426 |
| C35 | 897.80 to 912.20 | 23.324 to 23.862 | 2.4805 |
| C36 | 912.20 to 924.80 | 23.862 to 24.333 | 2.0827 |
| C37 | 924.80 to 937.40 | 24.333 to 24.853 | 2.2332 |
| C38 | 937.40 to 948.00 | 24.853 to 25.292 | 1.7959 |
| C39 | 948.00 to 960.80 | 25.292 to 25.782 | 1.9096 |
| C40 | 960.80 to 973.00 | 25.782 to 26.252 | 1.7619 |
| C42 | 973.00 to 994.00 | 26.252 to 27.123 | 3.0775 |
| C44 | 994.00 to 1014.00 | 27.123 to 27.952 | 2.7426 |
| C46 | 1014.00 to 1034.00 | 27.952 to 28.747 | 2.4525 |
| C48 | 1034.00 to 1052.00 | 28.747 to 29.507 | 2.1531 |
| C50 | 1052.00 to 1068.00 | 29.507 to 30.233 | 1.8898 |
| C52 | 1068.00 to 1084.00 | 30.233 to 30.926 | 1.6737 |
| C54 | 1084.00 to 1099.00 | 30.926 to 31.599 | 1.5124 |
| C56 | 1099.00 to 1113.00 | 31.599 to 32.238 | 1.3471 |
| C58 | 1113.00 to 1127.00 | 32.238 to 32.856 | 1.2238 |
| C60 | 1127.00 to 1140.00 | 32.856 to 33.450 | 1.1120 |
| C62 | 1140.00 to 1153.00 | 33.450 to 34.031 | 1.0306 |
| C64 | 1153.00 to 1165.00 | 34.031 to 34.587 | 0.9349 |
| C66 | 1165.00 to 1176.00 | 34.587 to 35.122 | 0.8504 |
| C68 | 1176.00 to 1187.00 | 35.122 to 35.640 | 0.7860 |
| C70 | 1187.00 to 1198.00 | 35.640 to 36.155 | 0.7499 |
| C72 | 1198.00 to 1208.00 | 36.155 to 36.649 | 0.6793 |
| C74 | 1208.00 to 1217.00 | 36.649 to 37.119 | 0.6094 |
| C76 | 1217.00 to 1228.00 | 37.119 to 37.583 | 0.5674 |
| C78 | 1228.00 to 1239.00 | 37.583 to 38.041 | 0.5302 |
| C80 | 1239.00 to 1248.00 | 38.041 to 38.472 | 0.4667 |
| C82 | 1248.00 to 1259.00 | 38.472 to 38.910 | 0.4498 |
| C84 | 1259.00 to 1268.00 | 38.910 to 39.326 | 0.4001 |
| C86 | 1268.00 to 1277.00 | 39.326 to 39.747 | 0.3866 |
| C88 | 1277.00 to 1284.00 | 39.747 to 40.131 | 0.3311 |
| C90 | 1293.00 to 1300.00 | 40.131 to 40.540 | 0.3341 |
| C92 | 1293.00 to 1300.00 | 40.540 to 40.919 | 0.2906 |
| C94 | 1300.00 to 1307.00 | 40.919 to 41.277 | 0.2632 |
| C96 | 1307.00 to 1315.00 | 41.277 to 41.651 | 0.2583 |
| C98 | 1315.00 to 1328.00 | 41.651 to 42.306 | 0.4190 |
| C100+ | 1328.00 to 1600.00 | 42.306 to 55.712 | 1.3995 |

TABLE 3

| Sample 2 | | | |
|---|---|---|---|
| Carbon Chain Length | Temperature Range (° F.) | Time Range (s) | Mass % of Total Sample Detected for Each Group (w/w) |
| C1 | −400.00 to −258.70 | −0.354 to −0.210 | 0.0000 |
| C2 | −258.70 to −127.50 | −0.210 to −0.077 | 0.0000 |
| C3 | −127.50 to −44.00 | −0.077 to 0.008 | 0.0000 |
| C4 | −44.00 to 31.10 | 0.008 to 0.084 | 0.0002 |
| C5 | 31.10 to 97.00 | 0.184 to 0.151 | 0.0571 |
| C6 | 97.00 to 157.00 | 0.151 to 0.330 | 0.0003 |
| C7 | 157.00 to 209.00 | 0.330 to 0.590 | 0.0000 |
| C8 | 209.00 to 259.00 | 0.590 to 1.268 | 0.0004 |
| C9 | 259.00 to 303.00 | 1.268 to 2.385 | 0.0017 |
| C10 | 303.00 to 345.00 | 2.385 to 3.695 | 0.0058 |
| C11 | 345.00 to 385.00 | 3.695 to 4.999 | 0.0081 |
| C12 | 385.00 to 421.00 | 4.999 to 6.251 | 0.0027 |
| C13 | 421.00 to 455.00 | 6.251 to 7.440 | 0.0000 |
| C14 | 455.00 to 489.00 | 7.440 to 8.566 | 0.0115 |
| C15 | 489.00 to 520.00 | 8.566 to 9.633 | 0.0812 |
| C16 | 520.00 to 549.00 | 9.633 to 10.650 | 0.2622 |
| C17 | 549.00 to 576.00 | 10.650 to 11.617 | 0.7411 |
| C18 | 576.00 to 601.00 | 11.617 to 12.539 | 1.4922 |
| C19 | 601.00 to 626.20 | 12.539 to 13.410 | 2.3302 |
| C20 | 626.20 to 649.80 | 13.410 to 14.227 | 2.7645 |
| C21 | 649.80 to 673.70 | 14.227 to 15.066 | 3.8544 |
| C22 | 673.70 to 695.00 | 15.066 to 15.815 | 3.6367 |
| C23 | 695.00 to 716.20 | 15.815 to 16.592 | 4.3441 |
| C24 | 716.20 to 736.00 | 16.592 to 17.319 | 4.0799 |
| C25 | 736.00 to 755.20 | 17.319 to 18.006 | 3.8918 |
| C26 | 755.20 to 773.60 | 18.006 to 18.664 | 3.8768 |
| C27 | 773.60 to 791.40 | 18.664 to 19.333 | 4.1203 |
| C28 | 791.40 to 808.00 | 19.333 to 19.958 | 3.7106 |
| C29 | 808.00 to 824.70 | 19.958 to 20.575 | 3.5077 |
| C30 | 824.70 to 840.60 | 20.575 to 21.162 | 3.1807 |
| C31 | 840.60 to 855.70 | 21.162 to 21.710 | 2.8038 |
| C32 | 855.70 to 871.00 | 21.710 to 22.265 | 2.7533 |
| C33 | 871.00 to 885.20 | 22.265 to 22.826 | 2.6816 |
| C34 | 885.20 to 897.80 | 22.826 to 23.324 | 2.3377 |
| C35 | 897.80 to 912.20 | 23.324 to 23.862 | 2.4805 |
| C36 | 912.20 to 924.80 | 23.862 to 24.333 | 2.0856 |
| C37 | 924.80 to 937.40 | 24.333 to 24.853 | 2.2408 |
| C38 | 937.40 to 948.00 | 24.853 to 25.292 | 1.8072 |
| C39 | 948.00 to 960.80 | 25.292 to 25.782 | 1.9176 |
| C40 | 960.80 to 973.00 | 25.782 to 26.252 | 1.7761 |
| C42 | 973.00 to 994.00 | 26.252 to 27.123 | 3.0957 |
| C44 | 994.00 to 1014.00 | 27.123 to 27.952 | 2.7707 |
| C46 | 1014.00 to 1034.00 | 27.952 to 28.747 | 2.4840 |
| C48 | 1034.00 to 1052.00 | 28.747 to 29.507 | 2.1810 |
| C50 | 1052.00 to 1068.00 | 29.507 to 30.233 | 1.9173 |
| C52 | 1068.00 to 1084.00 | 30.233 to 30.926 | 1.7002 |
| C54 | 1084.00 to 1099.00 | 30.926 to 31.599 | 1.5359 |
| C56 | 1099.00 to 1113.00 | 31.599 to 32.238 | 1.3714 |
| C58 | 1113.00 to 1127.00 | 32.238 to 32.856 | 1.2442 |
| C60 | 1127.00 to 1140.00 | 32.856 to 33.450 | 1.1294 |
| C62 | 1140.00 to 1153.00 | 33.450 to 34.031 | 1.0485 |
| C64 | 1153.00 to 1165.00 | 34.031 to 34.587 | 0.9496 |
| C66 | 1165.00 to 1176.00 | 34.587 to 35.122 | 0.8632 |
| C68 | 1176.00 to 1187.00 | 35.122 to 35.640 | 0.7977 |
| C70 | 1187.00 to 1198.00 | 35.640 to 36.155 | 0.7585 |
| C72 | 1198.00 to 1208.00 | 36.155 to 36.649 | 0.6875 |
| C74 | 1208.00 to 1217.00 | 36.649 to 37.119 | 0.6144 |
| C76 | 1217.00 to 1228.00 | 37.119 to 37.583 | 0.5712 |
| C78 | 1228.00 to 1239.00 | 37.583 to 38.041 | 0.5336 |
| C80 | 1239.00 to 1248.00 | 38.041 to 38.472 | 0.4692 |
| C82 | 1248.00 to 1259.00 | 38.472 to 38.910 | 0.4522 |
| C84 | 1259.00 to 1268.00 | 38.910 to 39.326 | 0.3999 |
| C86 | 1268.00 to 1277.00 | 39.326 to 39.747 | 0.3869 |
| C88 | 1277.00 to 1284.00 | 39.747 to 40.131 | 0.3302 |
| C90 | 1293.00 to 1300.00 | 40.131 to 40.540 | 0.3332 |
| C92 | 1293.00 to 1300.00 | 40.540 to 40.919 | 0.2886 |
| C94 | 1300.00 to 1307.00 | 40.919 to 41.277 | 0.2608 |
| C96 | 1307.00 to 1315.00 | 41.277 to 41.651 | 0.2559 |
| C98 | 1315.00 to 1328.00 | 41.651 to 42.306 | 0.4131 |
| C100+ | 1328.00 to 1600.00 | 42.306 to 55.712 | 1.3096 |

FIG. 2 is a chart depicting the mass percentage of the initial sample that corresponds to each group. Groups C1-C40 were detected in increments of one carbon unit, while groups C41-C98 were detected in increments of two carbon units. Thus, FIG. 2 depicts an over 1% increase in carbons detected between C40 and C42; however, this is likely due to the C42 data point actually including data for C41 as well (i.e., molecules containing both 41 carbons and 42 carbons). The C100+ group includes detected molecules containing 100 or more carbons. As can be seen from FIG. 2, Sample 1 and Sample 2 elicited similar simulated distillation profiles.

Figure 3:
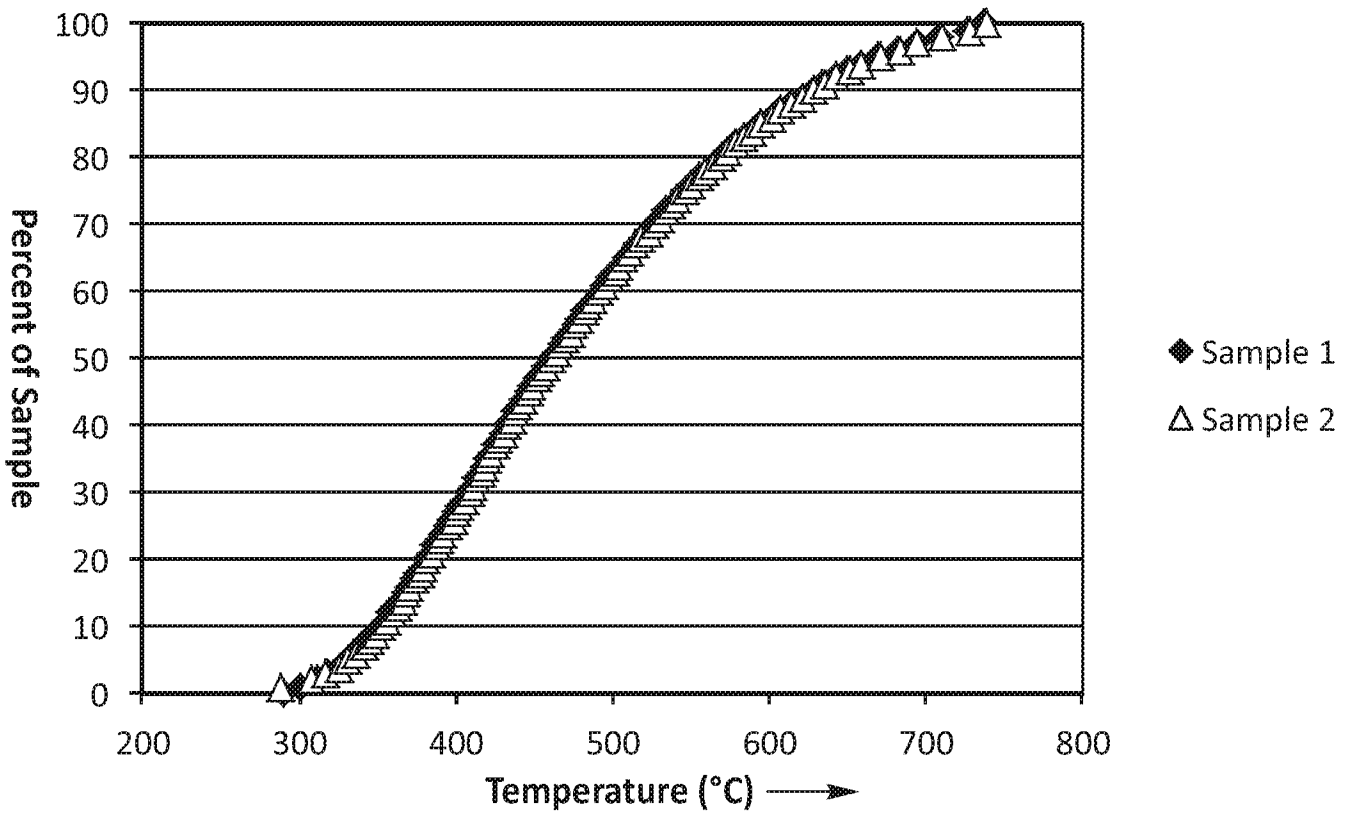
FIG. 3 is a graph of the boiling point distribution for the same two vacuum gas oil (VGO) samples.

Based on the data obtained in the simulated distillation experiment, the boiling point distributions for both Sample 1 and Sample 2 were generated. These distributions are described in tabular format in Table 4 and graphically depicted in FIG. 3. In Table 4, the first column indicates that percentage of sample that had a boiling point within or below the temperature specified in the second and third columns.

TABLE 4

| | Sample 1 (° C.) | Sample 2 (° C.) |
|---|---|---|
| 1% | 301.0 | 287.8 |
| 2% | 311.7 | 307.6 |
| 3% | 318.0 | 316.7 |
| 4% | 325.6 | 325.1 |
| 5% | 330.2 | 330.4 |
| 6% | 335.2 | 335.9 |
| 7% | 340.5 | 341.5 |
| 8% | 343.7 | 344.4 |
| 9% | 347.6 | 348.8 |
| 10% | 351.6 | 353.0 |
| 11% | 355.3 | 356.1 |
| 12% | 357.3 | 358.7 |
| 13% | 361.1 | 362.3 |
| 14% | 364.5 | 365.9 |
| 15% | 367.9 | 368.6 |
| 16% | 369.6 | 370.8 |
| 17% | 372.9 | 373.9 |
| 18% | 375.9 | 377.0 |
| 19% | 379.2 | 379.8 |
| 20% | 380.8 | 381.6 |
| 21% | 383.8 | 384.7 |
| 22% | 386.8 | 387.6 |
| 23% | 390.0 | 390.4 |
| 24% | 391.7 | 392.1 |
| 25% | 394.6 | 395.2 |
| 26% | 397.7 | 398.1 |
| 27% | 400.8 | 401.0 |
| 28% | 402.6 | 402.7 |
| 29% | 405.4 | 405.7 |
| 30% | 408.3 | 408.5 |
| 31% | 411.2 | 411.2 |
| 32% | 413.0 | 413.0 |
| 33% | 415.7 | 415.7 |
| 34% | 418.3 | 418.2 |
| 35% | 420.9 | 420.7 |
| 36% | 422.7 | 422.6 |
| 37% | 425.4 | 425.1 |
| 38% | 428.1 | 427.8 |
| 39% | 430.6 | 430.4 |
| 40% | 432.9 | 432.5 |
| 41% | 435.8 | 435.3 |
| 42% | 438.7 | 438.1 |
| 43% | 441.0 | 440.5 |
| 44% | 443.8 | 443.2 |
| 45% | 446.8 | 446.1 |
| 46% | 449.3 | 448.8 |
| 47% | 452.4 | 451.7 |
| 48% | 455.5 | 454.7 |
| 49% | 458.2 | 457.6 |
| 50% | 461.4 | 460.6 |
| 51% | 464.6 | 463.8 |
| 52% | 467.5 | 466.7 |
| 53% | 470.6 | 469.7 |
| 54% | 473.5 | 472.8 |
| 55% | 476.4 | 475.6 |
| 56% | 479.6 | 478.7 |
| 57% | 482.5 | 481.6 |
| 58% | 485.9 | 484.9 |
| 59% | 488.9 | 488.1 |
| 60% | 492.4 | 491.4 |
| 61% | 495.7 | 494.9 |
| 62% | 498.8 | 497.9 |
| 63% | 502.0 | 501.3 |
| 64% | 505.1 | 504.3 |
| 65% | 508.4 | 507.7 |
| 66% | 512.0 | 511.0 |
| 67% | 515.7 | 514.9 |
| 68% | 519.6 | 518.7 |
| 69% | 523.3 | 522.5 |
| 70% | 527.2 | 526.4 |
| 71% | 531.0 | 530.1 |
| 72% | 534.6 | 533.8 |
| 73% | 538.7 | 537.9 |
| 74% | 542.7 | 541.9 |
| 75% | 546.9 | 546.0 |
| 76% | 551.3 | 550.5 |
| 77% | 555.8 | 555.1 |
| 78% | 560.3 | 559.7 |
| 79% | 565.0 | 564.3 |
| 80% | 569.5 | 569.0 |
| 81% | 574.2 | 573.7 |
| 82% | 579.2 | 578.7 |
| 83% | 584.5 | 584.1 |
| 84% | 589.8 | 589.6 |
| 85% | 595.4 | 595.1 |
| 86% | 601.2 | 601.0 |
| 87% | 607.4 | 607.4 |
| 88% | 613.7 | 613.8 |
| 89% | 620.5 | 620.7 |
| 90% | 627.5 | 627.8 |
| 91% | 634.5 | 635.0 |
| 92% | 642.1 | 642.8 |
| 93% | 650.2 | 650.9 |
| 94% | 658.4 | 659.3 |
| 95% | 669.5 | 670.6 |
| 96% | 681.4 | 682.7 |
| 97% | 693.8 | 695.1 |
| 98% | 708.0 | 709.7 |
| 99% | 726.1 | 727.8 |
| 100% | 737.4 | 739.0 |

Example3—Viscosity of Vacuum Gas Oil-Diesel Fuel Mixtures

Sample 1, the vacuum gas oil sample of Example 1, was mixed with number two diesel fuel in a variety of ratios. The vacuum gas oil and diesel fuel were miscible at all ratios tested.

The dynamic viscosity of various VGO-diesel fuel blends was measured using a rheometer (Anton Paar MCR301). The rheometer was equipped with both a C-PTD200 Peltier temperature control device and a Julabo F 25 refrigerated/heating circulator filled with a 50:50 mix of ethylene glycol/water (v/v). Measurements were taken using a CC27/T200/SS measuring system that has concentric cylinder geometry. The circulating cooling system was set to −10° C. and the temperature control device was set to 50° C. The sample was then loaded and heated to 50° C. Once the sample had reached 50° C., measurements were taken every 10 seconds over a five-minute period at a shear rate of 300 $sec^{-1}$ (total 30 data points). The sample was then cooled at a rate of 0.5° C. per minute to −20° C., with measurements taken every 20 seconds over 140 minutes at a shear rate of 100 $sec^{-1}$.

Figure 4:
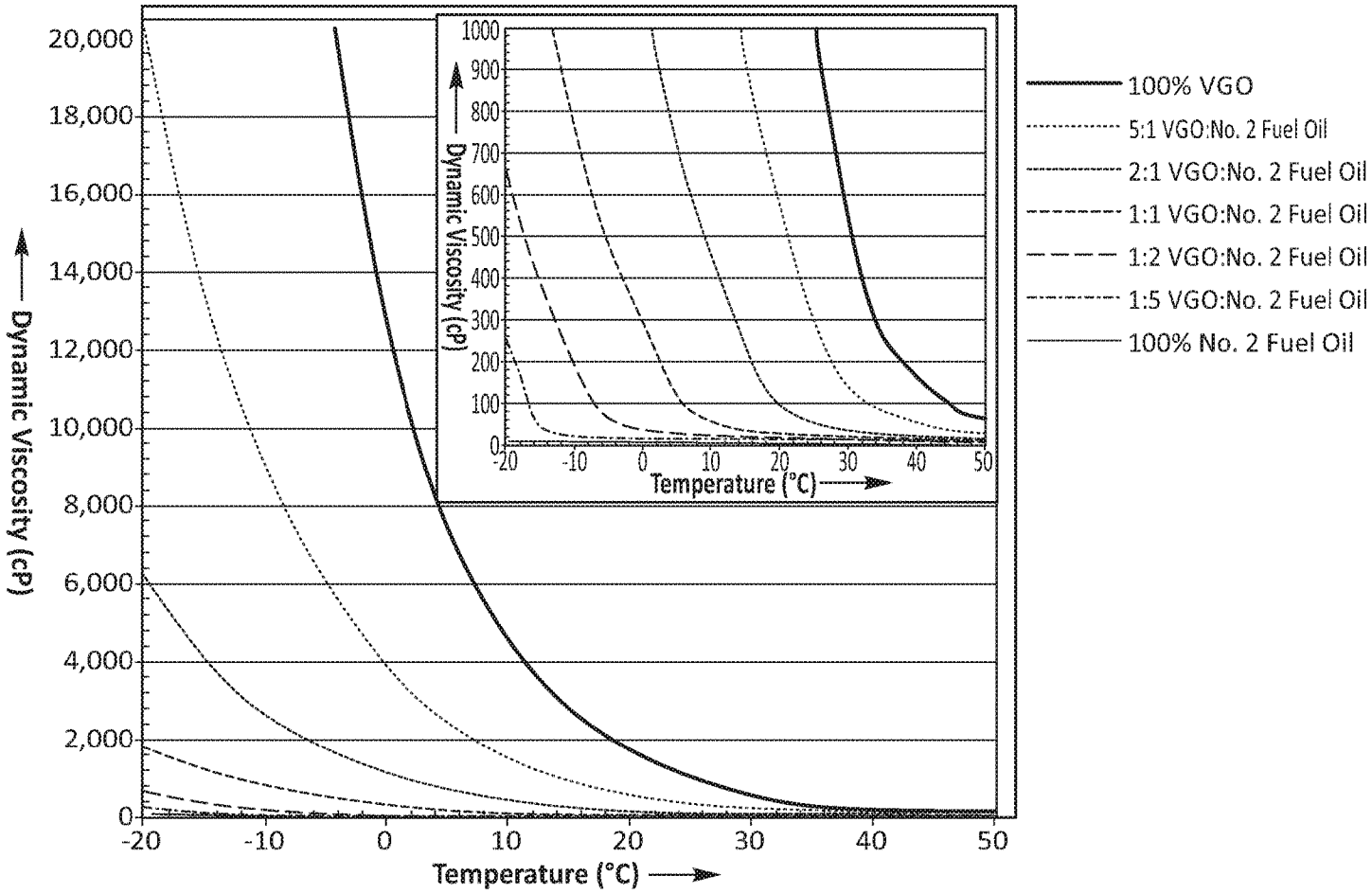
FIG. 4 is a graph of the dynamic viscosity of various exemplary diesel fuel and VGO blends.

FIG. 4 is a graph depicting the measured dynamic viscosity of various VGO-diesel fuel blends as described above. As can be seen from FIG. 4, dynamic viscosity tends to increase as the percentage of vacuum gas oil in the sample increases. The inset provides a blown-up view that shows only measured viscosity values below 1000 cP.

Example4—Blast Data for Various Explosive Compositions

Blast data for three emulsion explosives were collected. Each of the three explosive emulsions comprised aqueous ammonium nitrate in the discontinuous phase. Mixture 1 was a control. Mixtures 2 and 3 each comprised 15% and 20% VGO in the fuel phase, respectively. Each of the mixtures comprised 94.5% aqueous oxidizer (81% ammonium nitrate solution) and 5.5% fuel/emulsifier. Each of the mixtures only differed in the fuel phase. The fuel/emulsifier of Mixture 1 comprised 17.5% emulsifier, 50% mineral oil, and 32.5% diesel fuel. The fuel/emulsifier of Mixture 2 comprised 17.5% emulsifier, 15% VGO from Sample 1 and 67.5% diesel fuel. The fuel/emulsifier of Mixture 3 comprised 17.5% emulsifier, 20% VGO from Sample 1 and 62.5% diesel fuel. In each mixture the emulsifier was PIBSA-based.

An attempt was made to detonate each of the three emulsion explosives under various conditions and circumstances. These detonation attempts varied in the diameter of the explosive material used, the amount and type of booster used in each detonation attempt, and the number of times the emulsion had been pumped. The unconfined velocity of detonation was then measured. The results of these detonation experiments are summarized in Tables 5-8. In Tables 5-8, failed attempts to detonate particular mixtures are denoted as "Fail," and explosive emulsions that detonated but the velocity of detonation was not recorded are denoted as "Det." Unless otherwise indicated, pentaerythritol tetranitrate ("PETN") was used as the booster for each detonation. In some detonations, as indicated in Tables 5-8, a single charge of Anfodet (an aluminum shell with 2 grams of pressed PETN that receives a detonator) was used as the booster. In some cases, a #12 booster was used. A #12 booster is a detonator that comprises of 1 gram of explosives, mostly PETN with a small amount of lead azide. As can be seen in Tables 5-8, Mixtures 2 and 3 performed just as well or better than the control.

TABLE 5

| No Pump | | | |
|---|---|---|---|
| Mixture | Diameter | Booster | Velocity (m/s) |
| 1 | 75 mm | 50 g | 5324 |
| 2 | 75 mm | #12 | Fail |
| 3 | 75 mm | 50 g | Det |
| 1 | 63 mm | 10 g | 5120 |
| 2 | 63 mm | 10 g | 5759 |
| 3 | 63 mm | 10 g | 5682 |
| 1 | 63 mm | 5 g | Det |
| 2 | 63 mm | 5 g | Det |
| 3 | 63 mm | 5 g | Det |
| 1 | 63 mm | Anfodet | Fail |
| 2 | 63 mm | Anfodet | Det |
| 3 | 63 mm | Anfodet | Det |
| 1 | 50 mm | 50 g | 4884 |
| 2 | 50 mm | 50 g | 5302 |
| 3 | 50 mm | 50 g | 5415 |
| 1 | 38 mm | 50 g | 4729 |

TABLE 5-continued

| No Pump | | | |
|---|---|---|---|
| Mixture | Diameter | Booster | Velocity (m/s) |
| 2 | 38 mm | 90 g | 4865 |
| 3 | 38 mm | 90 g | 4828 |
| 1 | 32 mm | 20 g | 4440 |
| 2 | 32 mm | 90 g | 4425 |
| 3 | 32 mm | 90 g | 4601 |

TABLE 6

| First Pump | | | |
|---|---|---|---|
| Mixture | Diameter | Booster | Velocity (m/s) |
| 1 | 75 mm | 50 g | 5392 |
| 2 | 75 mm | 50 g | 5485 |
| 3 | 75 mm | 50 g | 5665 |
| 1 | 63 mm | 10 g | 5302 |
| 2 | 63 mm | 10 g | 5607 |
| 3 | 63 mm | 10 g | 5302 |
| 1 | 63 mm | 5 g | Det |
| 2 | 63 mm | 5 g | Det |
| 3 | 63 mm | 5 g | Det |
| 1 | 63 mm | Anfodet | Fail |
| 2 | 63 mm | Anfodet | Det |
| 3 | 63 mm | Anfodet | Det |
| 1 | 50 mm | 50 g | 4783 |
| 2 | 50 mm | 50 g | 5280 |
| 3 | 50 mm | 50 g | 5302 |
| 1 | 38 mm | 50 g | 4349 |
| 2 | 38 mm | 90 g | 4838 |
| 3 | 38 mm | 90 g | 4783 |
| 1 | 32 mm | 20 g | Fail |
| 2 | 32 mm | 90 g | 4515 |
| 3 | 32 mm | 90 g | 4432 |

TABLE 7

| Second Pump | | | |
|---|---|---|---|
| Mixture | Diameter | Booster | Velocity (m/s) |
| 1 | 75 mm | 50 g | 5255 |
| 2 | 75 mm | 50 g | 5631 |
| 3 | 75 mm | 50 g | 5682 |
| 1 | 63 mm | 10 g | 5557 |
| 2 | 63 mm | 10 g | 5557 |
| 3 | 63 mm | 10 g | 5695 |
| 1 | 63 mm | 5 g | Det |
| 2 | 63 mm | 5 g | Det |
| 3 | 63 mm | 5 g | Det |
| 2 | 63 mm | Anfodet | Det |
| 3 | 63 mm | Anfodet | Det |
| 1 | 50 mm | 50 g | 4660 |
| 2 | 50 mm | 50 g | 5173 |
| 3 | 50 mm | 50 g | 5258 |
| 1 | 38 mm | 90 g | 4143 |
| 2 | 38 mm | 90 g | 4783 |
| 3 | 38 mm | 90 g | 4677 |
| 1 | 32 mm | 90 g | Fail |
| 2 | 32 mm | 90 g | 4440 |
| 3 | 32 mm | 90 g | 4425 |

TABLE 8

| Third Pump | | | |
|---|---|---|---|
| Mixture | Diameter | Booster | Velocity (m/s) |
| 1 | 75 mm | 50 g | 4951 |
| 2 | 75 mm | 50 g | 5657 |
| 3 | 75 mm | 50 g | 5707 |
| 1 | 63 mm | 10 g | 4884 |
| 2 | 63 mm | 10 g | 5427 |
| 3 | 63 mm | 10 g | 5879 |
| 1 | 63 mm | 5 g | Det |
| 2 | 63 mm | 5 g | Det |
| 3 | 63 mm | 5 g | Det |
| 2 | 63 mm | Anfodet | Det |
| 3 | 63 mm | Anfodet | Det |
| 1 | 50 mm | 50 g | 4437 |
| 2 | 50 mm | 50 g | 5152 |
| 3 | 50 mm | 50 g | 5204 |
| 1 | 38 mm | 90 g | 3956 |
| 2 | 38 mm | 90 g | 4116 |
| 3 | 38 mm | 90 g | 4356 |
| 2 | 32 mm | 90 g | 3659 |
| 3 | 32 mm | 90 g | 3409 |

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

It should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects may lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

It will be apparent to those having skill in the art, with the benefit of this disclosure, that changes may be made to the details of the above-described embodiments without departing from the underlying principles of the present disclosure.

The invention claimed is:

1. An emulsion matrix for use in explosives that comprises a continuous phase and a discontinuous phase, wherein:

the discontinuous phase comprises an oxidizer;

the continuous phase comprises a diesel fuel and a vacuum gas oil; and the continuous phase is about 10% to about 35% vacuum gas oil by weight and wherein the diesel fuel comprises a middle distillate obtained from atmospheric distillation.

2. The emulsion matrix of claim 1, wherein a blend of the diesel fuel and the vacuum gas oil in the continuous phase has a viscosity of about 100 to about 8000 cP at −20° C. and atmospheric pressure.

3. The emulsion matrix of claim 1, wherein the vacuum gas oil has a viscosity of about 30 cP to about 400 cP at 40° C. and atmospheric pressure.

4. The emulsion matrix of claim 1, wherein the diesel fuel is miscible with the vacuum gas oil at standard temperature and pressure.

5. The emulsion matrix of claim 1, wherein the vacuum gas oil comprises hydrocarbon molecules, wherein 85% or more of the hydrocarbon molecules have more than about 20 carbon atoms.

6. The emulsion matrix of claim 1, wherein:

the vacuum gas oil comprises hydrocarbon molecules; and a distribution of carbon chain lengths for the hydrocarbon molecules comprises an absolute maximum peak at about 20 to about 30 carbon atoms.

7. The emulsion matrix of claim 1, wherein the vacuum gas oil is obtained by vacuum distillation of material that did not substantially volatilize during distillation of crude oil at atmospheric pressure.

8. The emulsion matrix of claim 1, wherein the vacuum gas oil has an American Petroleum Institute (API) gravity of about 10° API to about 30° API; a pour point of about 20° C. to about 50° C.; a flash point of about >110° C. to about >150° C.; an aniline point of about 80° C. to about 120° C.; an initial boiling point of about 200° C. to about 400° C.; volatilizes at about 230° C. to about 600° C.; or a combination thereof.

9. The emulsion matrix of claim 1, wherein the diesel fuel comprises number 2 fuel oil.

10. The emulsion matrix of claim 1, wherein the oxidizer comprises a nitrate or perchlorate salt.

11. An emulsion explosive comprising the emulsion matrix of claim 1 and a sensitizing agent.

12. A method of making an emulsion explosive, the method comprising:

providing the emulsion matrix of claim 1; and sensitizing the emulsion matrix to form an emulsion explosive.

13. An emulsion matrix for use in explosives that comprises a continuous phase and a discontinuous phase, wherein:

the discontinuous phase comprises an oxidizer;

the continuous phase comprises a diesel fuel and a vacuum gas oil, wherein the vacuum gas oil has an American Petroleum Institute (API) gravity of about 10° API to about 30° API; a pour point of about 20° C. to about 50° C.; a flash point of about >110° C. to about >150° C.; an aniline point of about 80° C. to about 120° C.; an initial boiling point of about 200° C. to about 400° C.; volatilizes at about 230° C. to about 600° C.; or a combination thereof; and the continuous phase is about 10% to about 35% vacuum gas oil by weight.

14. A fuel for use in explosive mixtures, the fuel comprising a blend of a diesel fuel and a vacuum gas oil, wherein the fuel is about 20% to about 70% vacuum gas oil by weight and wherein the diesel fuel comprises a middle distillate obtained from atmospheric distillation.

15. The fuel of claim 14, wherein the fuel is about 25% to about 66% vacuum gas oil by weight.

16. The fuel of claim 14, wherein the blend of the diesel fuel and the vacuum gas oil has a viscosity of about 1000 cP to about 8000 cP at −20° C. and atmospheric pressure; the blend of the diesel fuel and the vacuum gas oil has a viscosity of about 50 cP to about 2000 cP at 0° C. and atmospheric pressure; or both.

17. The fuel of claim 14, wherein the vacuum gas oil comprises hydrocarbon molecules and about 50% to about 75% of the hydrocarbon molecules have about 20 to about 40 carbon atoms.

18. The fuel of claim 14, wherein the vacuum gas oil is obtained by a process that comprises distillation at one or more pressures of about 1 mm Hg to about 100 mm Hg.

19. The fuel of claim 14, wherein the diesel fuel comprises number 2 fuel oil.

20. An explosive mixture comprising:

the fuel of claim 14; and an oxidizer.

21. A method of making an explosive mixture, the method comprising:

providing the fuel of claim 14; and mixing the fuel with an oxidizer.

22. The fuel of claim 14, wherein the vacuum gas oil has a viscosity of about 30 cP to about 400 cP at 40° C. and atmospheric pressure.

23. The fuel of claim 14, wherein the diesel fuel is miscible with the vacuum gas oil at standard temperature and pressure.

24. The fuel of claim 14, wherein the vacuum gas oil comprises hydrocarbon molecules, wherein 85% or more of the hydrocarbon molecules have more than about 20 carbon atoms.

25. The fuel of claim 14, wherein:

the vacuum gas oil comprises hydrocarbon molecules; and a distribution of carbon chain lengths for the hydrocarbon molecules comprises an absolute maximum peak at about 20 to about 30 carbon atoms.

26. The fuel of claim 14, wherein the vacuum gas oil is obtained by vacuum distillation of material that did not substantially volatilize during distillation of crude oil at atmospheric pressure.

27. The fuel of claim 14, wherein the vacuum gas oil has an American Petroleum Institute (API) gravity of about 10° API to about 30° API; a pour point of about 20° C. to about 50° C.; a flash point of about >110° C. to about >150° C.; an aniline point of about 80° C. to about 120° C.; an initial boiling point of about 200° C. to about 400° C.; volatilizes at about 230° C. to about 600° C.; or a combination thereof.

28. A fuel for use in explosive mixtures, the fuel comprising a blend of a diesel fuel and a vacuum gas oil, wherein the fuel is about 20% to about 70% vacuum gas oil by weight, and wherein the vacuum gas oil has an American Petroleum Institute (API) gravity of about 10° API to about 30° API; a pour point of about 20° C. to about 50° C.; a flash point of about >110° C. to about >150° C.; an aniline point of about 80° C. to about 120° C.; an initial boiling point of about 200° C. to about 400° C.; volatilizes at about 230° C. to about 600° C.; or a combination thereof.

* * * * *